United States Patent [19]

Burton et al.

[11] 4,149,592

[45] Apr. 17, 1979

[54] CONTAINERS FOR INDICATORS

[75] Inventors: Robert S. Burton; Carl C. Chambers, both of Grand Junction, Colo.

[73] Assignee: Occidental Oil Shale, Inc., Grand Junction, Colo.

[21] Appl. No.: 801,631

[22] Filed: May 31, 1977

[51] Int. Cl.[2] ..... E21B 43/24; E21B 47/00

[52] U.S. Cl. ..... 166/64; 166/164; 166/251; 299/2

[58] Field of Search ..... 166/164, 64, 250, 251, 166/57, 288, 302, 162, 165, 167, 169; 175/39, 42

[56] References Cited

U.S. PATENT DOCUMENTS

| | | | |
|---|---|---|---|
| 2,658,724 | 11/1953 | Arps | 175/39 X |
| 3,011,566 | 12/1961 | Graham | 175/39 |
| 3,057,405 | 10/1962 | Mallinger | 166/288 |
| 3,072,184 | 1/1963 | Parker | 166/262 X |
| 3,116,450 | 12/1963 | Longwill | 166/162 X |
| 3,155,176 | 11/1964 | Bennett | 175/42 |
| 3,678,883 | 7/1972 | Fischer | 175/39 X |

*Primary Examiner*—Stephen J. Novosad
*Attorney, Agent, or Firm*—Christie, Parker & Hale

[57] ABSTRACT

An apparatus is provided for determining the locus of a processing zone which advances through a fragmented permeable mass of particles in an in situ oil shale retort in a subterranean formation containing oil shale. The apparatus, which functions by releasing means for providing an indicator at a preselected temperature, comprises container means, means for providing an indicator in the container, and means for releasing the indicator providing means at a selected temperature greater than ambient.

30 Claims, 6 Drawing Figures

CONTAINERS FOR INDICATORS

CROSS REFERENCE

This application is related to U.S. Patent Application Ser. No. 798,376, filed on May 9, 1977 by Robert S. Burton, entitled "Use of Containers for Dopants to Determine the Locus of a Processing Zone in a Retort", and assigned to the assignee of this application.

BACKGROUND

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale nor does it contain oil. It is a sedimentary formation comprising marlstone deposit having layers containing an organic polymer called "kerogen", which upon heating decomposes to produce hydrocarbon liquid and gaseous products. It is the formation containing kerogen that is called "oil shale" herein, and the liquid hydrocarbon product is called "shale oil".

A number of methods have been proposed for processing oil shale which involve either first mining the kerogen bearing shale and processing the shale above ground, or processing the oil shale in situ. The latter approach is preferable from the standpoint of environmental impact since the spent shale remains in place, reducing the chance of surface contamination and the requirement for disposal of solid wastes.

The recovery of liquid and gaseous products from oil shale deposits has been described in several patents, one of which is U.S. Pat. No. 3,661,423, issued May 9, 1972 to Donald E. Garrett, assigned to the assignee of this application, and incorporated herein by this reference. This patent describes in situ recovery of liquid and gaseous hydrocarbon materials from a subterranean formation containing oil shale by mining out a portion of the subterranean formation and then fragmenting a portion of the remaining formation to form a stationary, fragmented permeable mass of formation particles containing oil shale, referred to herein as an in situ oil shale retort. Hot retorting gases are passed through the in situ oil shale retort to convert kerogen contained in the oil shale to liquid and gaseous products.

One method of supplying hot retorting gases used for converting kerogen contained in the oil shale, as described in U.S. Pat. No. 3,661,423, includes establishment of a combustion zone in the retort and introduction of an oxygen containing retort inlet mixture into the retort as a gaseous combustion zone feed to advance the combustion zone through the retort. In the combustion zone oxygen in the combustion zone feed is depleted by reaction with hot carbonaceous materials to produce heat and combustion gas. By the continued introduction of the gaseous combustion zone feed into the combustion zone, the combustion zone is advanced through the retort. The combustion zone is maintained at a temperature lower than the fusion temperature of oil shale, which is about 2100° F., to avoid plugging of the retort, and above about 1100° F. for efficient recovery of hydrocarbon products from the oil shale.

The effluent gas from the combustion zone comprises combustion gas and any gaseous portion of the combustion zone feed that does not take part in the combustion process. This effluent gas is essentially free of free oxygen and contains constituents such as oxides of carbon and sulfurous compounds. It passes through the fragmented mass in the retort on the advancing side of the combustion zone to heat oil shale in a retorting zone to a temperature sufficient to produce kerogen decomposition, called retorting, in the oil shale to gaseous and liquid products and to a residue of solid carbonaceous material.

The liquid products and gaseous products are cooled by cooler particles in the fragmented mass in the retort on the advancing side of the retorting zone. The liquid hydrocarbon products, together with water produced in or added to the retort, are collected at the bottom of the retort and withdrawn to the surface through an access tunnel, drift or shaft. An off gas containing combustion gas generated in the combustion zone, gaseous products produced in the retorting zone, gas from carbonate decomposition, and any gaseous portion of the combustion zone feed that does not take part in the combustion process is also withdrawn to the surface.

It is desirable to know the locus of the combustion and retorting processing zones as they advance through an in situ oil shale retort for many reasons. One reason is that by knowing the locus of the combustion zone, steps can be taken to control the orientation of the advancing side of the combustion zone. It is desirable to maintain a combustion zone which is flat and uniformly transverse and preferably uniformly normal to the direction of its advancement. If the combustion zone is skewed relative to its direction of advancement, there is more tendency for oxygen present in the combustion zone to oxidize hydrocarbon products produced in the retorting zone, thereby reducing hydrocarbon yield. In addition, with a skewed combustion zone, more cracking of the hydrocarbon products can result. Monitoring the locus of parts of the combustion zone provides information for control of the advancement of the combustion zone to maintain it flat and uniformly perpendicular to the direction of its advancement to obtain high yield of hydrocarbon products.

Another reason that it can be desirable to monitor the locus of the combustion zone is to provide information so the composition of the combustion zone feed mixture can be varied with variations in the kerogen content of oil shale being retorted. Formation containing oil shale include horizontal strata or beds of varying kerogen content, including strata containing substantially no kerogen, and strata having a Fischer assay of 80 gallons per ton. If combustion zone feed containing too high a concentration of oxygen is introduced into a region of the retort containing oil shale having a high kerogen content, oxidation of carbonaceous material in the oil shale can generate so much heat that fusion of the oil shale can result, thereby producing a region of the fragmented mass which cannot be penetrated by retorting gases. High temperatures also can cause excessive endothermic carbonate decomposition to carbon dioxide and dilution of the off gas from the retort, thereby lowering the heating value of the off gas. Therefore, layers in the fragmented mass are correlated with strata in the unfragmented formation because there is little vertical mixing between strata when explosively fragmenting formation to form a fragmented permeable mass of formation particles. Therefore, samples of various strata through the retort can be taken before initiating retorting of the oil shale and assays can be conducted to determine the kerogen content. Such samples can be taken from within the fragmented mass, from formation before expansion, or from formation nearby the fragmented mass since little change in kerogen content of oil shale occurs over large areas of formation. Then, by monitoring the locus of the combustion zone as it advances through the retort, the composition of the combustion zone feed can be appropriately modified.

Another reason for monitoring the locus of the combustion and retorting processing zones as they advance through the retort is to monitor the performance of the retort to determine if sufficient shale oil is being produced for the amount of oil shale being retorted.

Also, by monitoring the locus of the combustion and retorting zones, it is possible to control the advancement of these two zones through the retort at an optimum rate. The rate of advancement of the combustion and retorting zones through the retort can be controlled by varying the flow rate and composition of the combustion zone feed. Knowledge of the locus of the combustion and retorting zones allows optimization of the rate of advancement to produce hydrocarbon products of the lowest cost possible with cognizance of the overall yield, fixed costs, and variable costs of producing the hydrocarbon products.

Thus, it is desirable to provide apparatus for monitoring advancement of combustion and retorting processing zones through an in situ oil shale retort.

BRIEF SUMMARY

The present invention concerns apparatus useful for determining the locus of a processing zone advancing through a subterranean formation, such as a combustion zone advancing through a fragmented permeable mass of particles in an in situ oil shale retort in a subterranean formation containing oil shale. The apparatus, which functions by releasing means for providing an indicator such as a halocarbon at a preselected temperature, comprises container means, means for providing an indicator in the container, and means for releasing the indicator providing means at a selected temperature greater than ambient. The means for releasing the indicator providing means can be a pressure break diaphragm or a fusible plug, such as a fusible plug consisting essentially of metallic zinc.

When the fragmented permeable mass of particles in an in situ oil shale retort is formed by explosive expansion of the formation and the apparatus is placed in the formation prior to such explosive expansion, the container and plug have sufficient strength that the container and plug survive such explosive expansion.

DRAWINGS

These and other features, aspects and advantages of the present invention will become more apparent upon consideration of the following description, appended claims, and accompanying drawings where:

FIG. 1 represents in horizontal cross section an in situ oil shale retort having indicator providing means;

FIG. 2, which is taken on line 2—2 in FIG. 1, schematically represents in vertical cross section the in situ oil shale retort of FIG. 1;

DESCRIPTION

Figure 2:
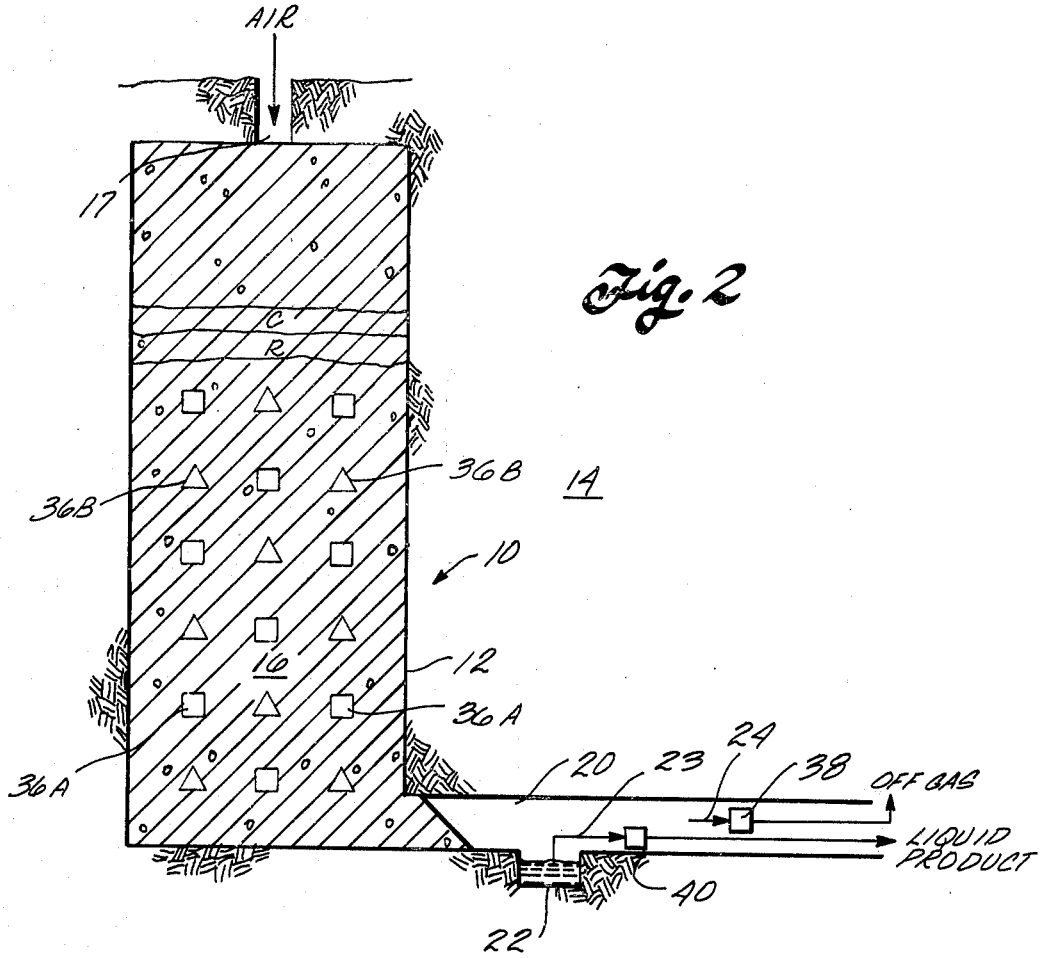
Figure 1:
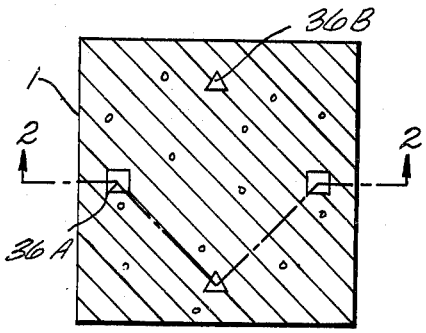

Referring FIGS. 1 and 2, an in situ oil shale retort 10 is in the form of a cavity 12 formed in a subterranean formation 14 containing oil shale. The cavity contains a fragmented permeable mass 16 of formation particles containing oil shale. The cavity 12 can be created simultaneously with fragmentation for forming the mass of formation particles 16. Such fragmentation is produced by blasting according to any of a variety of techniques. A desirable technique involves excavating or mining a void within the boundaries of an in situ oil shale retort site to be formed in the subterranean formation, and explosively expanding remaining oil shale in the formation toward such a void. A method of forming an in situ oil shale retort is described in U.S. Pat. No. 3,661,423. A variety of other techniques can also be used.

A conduit 17 communicates with the top of the fragmented mass of formation particles. During the retorting operation of the retort 10, a combustion processing zone C is established in the retort and advanced by introducing an oxygen containing retort inlet mixture such as air or air mixed with other fluids, into the in situ oil shale retort through the conduit 17 as a combustion zone feed. The combustion processing zone is the portion of the retort where the greater part of the oxygen in the combustion zone feed that reacts with residual carbonaceous material in retorted oil shale is consumed. Oxygen introduced to the retort in the retort inlet mixture oxidizes carbonaceous material in the oil shale to produce combustion gas. Heat from the exothermic oxidation reactions, carried by flowing gases, advances the combustion zone through the fragmented mass of particles.

Combustion gas produced in the combustion zone and any unreacted portion of the combustion zone feed pass through the fragmented mass of particles on the advancing side of the combustion zone to establish a retorting processing zone R on the advancing side of the combustion zone. Kerogen in the oil shale is retorted in the retorting zone to produce liquid and gaseous products.

There is an access tunnel, adit, drift 20 or the like, in communication with the bottom of the retort. The drift contains a sump 22 in which liquid products 23, including liquid hydrocarbon products and water, are collected to be withdrawn. An off gas 24 containing gaseous products, combustion gas, carbon dioxide from carbonate decomposition, and any unreacted gaseous portion of the combustion zone feed is also withdrawn from the in situ oil shale retort 10 by way of the drift 20. The liquid products and off gas are withdrawn from the retort as effluent fluids.

Retorting of oil shale can be carried out with combustion zone temperatures as low as about 800° F. However, in order to have retorting at an economical rate, it is preferred to maintain the combustion zone at least at about 1100° F. The upper limit on the temperature in the combustion zone is determined by the fusion temperature of oil shale, which is about 2100° F. The temperature in the combustion zone preferably is maintained below about 1800° F. to provide a margin of safety between the temperature in the combustion zone and the fusion temperature of the oil shale. In this specification, when the temperature of a combustion or retorting zone is mentioned, reference is being made to the maximum temperature in the zone.

Although the average temperature of the combustion zone is higher than the average temperature of the retorting zone, portions of the retorting zone can have a temperature higher than the temperature of portions of the combustion zone. This can be the result of commingling of the combustion and retorting zones.

There are placed at selected locations in the fragmented permeable mass 16 of particles in the retort 10 container means 36A and 36B which confine indicator means for providing an indicator. The containers release indicator means at a predetermined temperature greater than ambient and less than the maximum temperature in the retort, i.e., less than about 2100° F. The container means can be spaced equidistantly from each other or at any selected spacing. The indicator means for providing an indicator are referred to herein as "indicator means", "indicator providing means", "doping material", "dope", and "indicator sources".

Means can be provided for monitoring an effluent fluid from the retort for presence of indicators. For example, monitoring means 38 can be provided for monitoring the off gas 24 for presence of indicator. Similarly, monitoring means 40 can be provided for monitoring the liquid products 23 for presence of indicator. The water and/or liquid hydrocarbons withdrawn from the retort can be monitored.

The indicator means released by a container is not necessarily the same material placed in the container. For example, the indicator means released by a container can be a thermal decomposition product of the indicator for providing an indicator means originally placed in the container. Furthermore, the indicator for which monitoring is conducted is not necessarily the indicator means released by the container. Indicator present in effluent gas or liquid from the retort can be an indicator means, the reaction product of a reaction in which an indicator providing means is a reactant, a reaction product of a reaction in which an indicator providing means is a catalyst, a thermal decomposition product of an indicator providing means, and the like. For example, when a halocarbon such as trichloro-trifluoroethane is the indicator providing means, effluent gas from the retort can be monitored for $C_2F_3Cl_3$ itself, thermal decomposition products of the indicator providing means such as fluorine and chlorine, or reaction products of the indicator means such as $CF_3H$, $C_2H_5Cl$, $CF_4$, $C_2F_5H$, $COF_2$, $CF_3Cl$, $CF_2Cl_2$, $C_2F_4H_2$, $C_2F_6$, $CF_2HCl$, $C_2F_4Cl_2$, and the like.

The changes an indicator providing means can undergo are exemplified by use of cesium dibromochloride as an indicator providing means. At 150° C. cesium dibromochloride releases bromine gas. When cesium dibromochloride is placed in container means as an indicator providing means, the indicator providing means released by the container is bromine gas. The bromine gas can react with methane in off gas to yield methyl bromide. Off gas from the retort can be monitored for the methyl bromide. Thus, cesium dibromochloride is the indicator providing means originally placed in a container; bromine is the indicator providing means released by the container; and methyl bromide is the indicator which can be detected in the off gas.

The indicator source or indicator providing means used is one which provides an indicator which normally is not present in the effluent fluids from the retort, or is present prior to release of the indicator source at a concentration less than the concentration resulting from provision of the indicator by the indicator source. Sufficient indicator providing means needs to be released by the container that a concentration of indicator which is detectable in an effluent fluid is provided. For an indicator detectable in off gas, preferably the off gas has a background and concentration of no more than about 20 parts per million by volume of indicator so the presence of indicator in the off gas is not masked by the background concentration.

Exemplary of an indicator source is paraffin wax. An in situ oil shale retort can be doped with containers confining paraffin wax, and, as the retorting and combustion processing zones approach the containers, the wax melts and can flow out of the containers and appear in the liquid product stream 23. Monitoring means 40 such as a pour point analyzer can be provided in the drift 20 in communication with the bottom of the retort for monitoring the pour point of the liquid hydrocarbon portion of the liquid product stream 24. Since the liquid product stream can contain both a hydrocarbon fraction and a water fraction, preferably the hydrocarbon products are separated from the water as by decanting to provide a substantially waterfree carbonaceous fraction for feed to a pour point analyzer. An increase in the pour point of the hydrocarbon fraction due to the presence of melted paraffin wax indicates that the retorting zone and/or combustion zone has reached or is approaching the doping material.

Also exemplary of an indicator means is a radioactive indicator providing means such as krypton 85. By doping the retort 12 with a container confining krypton 85 and monitoring off gas 24 for the presence of the krypton 85, the locus of a processing zone advancing through the fragmented permeable mass 16 in the retort 12 can be determined. Monitoring means 38 for radioactivity can be provided in the drift for detecting the presence of krypton 85 in the off gas 24. Suitable radiation detection means include proportional counters, Geiger-Muller tubes, and the like.

Other indicators which can be provided for detection in the off gas include gases such as sulfur hexafluoride and inert gases such as helium, neon, xenon, and the like. Also halocarbons can be used. Exemplary of suitable halocarbons are the halocarbons sold by DuPont under the trademark Freon such as Freon 11 ($CCl_3F$), Freon 12 ($CCl_2F_2$), Freon 13 ($CClF_3$), Freon 113 ($CCl_2FCClF_2$) Freon 116 ($C_2F_6$), and the like. Advantages of using Freon gases as indicator means include low cost, thermal stability, non-toxicity availability, chemical stability, and absence of these gases in normal retort off gas. These gases also exhibit very low detection limits, i.e., less than 100 parts per million by volume by several analytical methods including mass spectrometry. Other detection methods which can be used for Freon gases include gas chromotography with electron capture detectors and infrared spectroscopy.

Another advantage of use of halocarbons is that they are available in a variety of fluorine to chlorine ratios and are also available with bromine. Therefore, different portions of the retort can be doped with different halocarbons, and by determining the fluorine to chlorine ratio in the off gas, the region from which the indicator has been released can be determined for accurate determination of the locus of a processing zone advancing through the retort. By using halocarbons containing bromine, an even larger variety of halocarbons for accurate determination of the locus of a processing zone can be effected.

An indicator which is visually detectable in the off gas, liquid hydrocarbon products, and/or water withdrawn from the retort can be used. For example, smoke bombs may be prepared by filling combustible containers with chemicals which produce colored smokes. U.S. Pat. No. 3,072,184 issued Jan. 8, 1963 lists various combinations of chemicals which can be utilized to produce various colored smokes, including red, yellow, green and blue smokes.

Several containers can be used which release indicator means at different temperatures. For example, a first container 36A can release indicator means at a temperature characteristic of the temperature in the retorting processing zone. A second container 36B can release indicator means at a temperature characteristic of the temperature of the combustion processing zone. Thus, as the retorting zone reaches a first container 36A, indicator means is released, and then as the combustion zone reaches a second container 36B, indicator means again is released. Preferably the indicator means released by the first and second containers are different from each other so the locus of both the retorting and combustion processing zones can be determined.

Preferably a plurality of containers containing indicator means are placed in the retort spaced apart from each other along the direction of advancement of a processing zone through the fragmented mass so the locus of the processing zone can be determined at various times as the processing zone advances. When the combustion and retorting zones are advancing downwardly or upwardly through the retort, the containers can be vertically spaced apart from each other.

Preferably at least two containers for a processing zone are placed in the retort in a plane substantially normal to the direction of advancement of the processing zone through the fragmented mass. When a processing zone is advancing downwardly or upwardly through the fragmented mass, preferably two or more containers laterally spaced apart from each other are provided at the same elevation in the retort. This permits determination of whether a processing zone advancing through the fragmented permeable mass is flat and uniformly transverse to its direction of advancement, or if the processing zone is skewed and/or warped. When the monitoring means detects a quantity or type of indicator commensurate with release of indicator providing means by more than one container, this indicates that the processing zone is uniformly transverse to its direction of advancement.

To determine if a processing zone is skewed and/or warped, more preferably at least three containers are provided in the retort in a plane substantially normal to the direction of advancement of a processing zone through the fragmented mass. At least three containers in the same plane are most preferred because as a matter of geometry, it takes three points to define a plane. Use of only two containers may not provide enough information to determine whether a processing zone is skewed.

Both containers spaced apart from each other along the direction of advancement of a processing zone and containers spaced apart from each other in a plane normal to the direction of advancement of a processing zone can be used in combination for determining if a processing zone is skewed and/or warped throughout the retorting process.

Preferably an indicator means is used in the containers which provides an indicator detectable in the off gas. This requires that at least a portion of the indicator be in the vapor phase at the temperature and pressure of the off gas. An advantage of using an indicator detectable in the off gas is that the composition of the off gas is more quickly responsive to changes in the retorting process than is the composition of the liquid product stream 23. This is because liquid products tend to "hang up" in the retort; that is, flow is retarded by contact between the liquids and the fragmented mass. For example, delays of as much as a week between initiation of retorting and collection of liquid products in the sump 22 can occur. When an indicator detectable only in the water and/or hydrocarbon products is used, a lag time of as much as a week can occur between movement of the processing zone through a region in which a container confining indicator means is located and detection of indicator in the effluent liquid from the retort. On the other hand, gases can pass downwardly through retort at five feet per minute and faster.

The containers can be placed at selected locations within the boundaries of a retort to be formed in the subterranean formation 14 by drilling boreholes downwardly from the ground surface or from a subterranean working level or base of operation above the retort to be formed, by drilling boreholes upwardly from a production level below the retort to be formed, and/or by drilling boreholes from a work level between the top and bottom of the retort to be formed. Then containers are placed into such boreholes within the boundaries of the retort to be formed. When placing containers within the retort boundaries from above the retort, the containers can be lowered into the boreholes, preferably suspended from a measuring rope for accurate determination of the elevation in the retort where a container means is placed. Stemming, which is an inert material typically used in shotholes between adjacent charges and between an explosive charge and the outer end of a shothole, can be used between containers in the boreholes. The stemming can be sand, gravel, or crushed shale.

Preferably, for ease of placement, the containers confining indicator means are placed in unfragmented formation in the retort site prior to blasting to form the cavity 12 and the fragmented mass 16.

Figure 5:
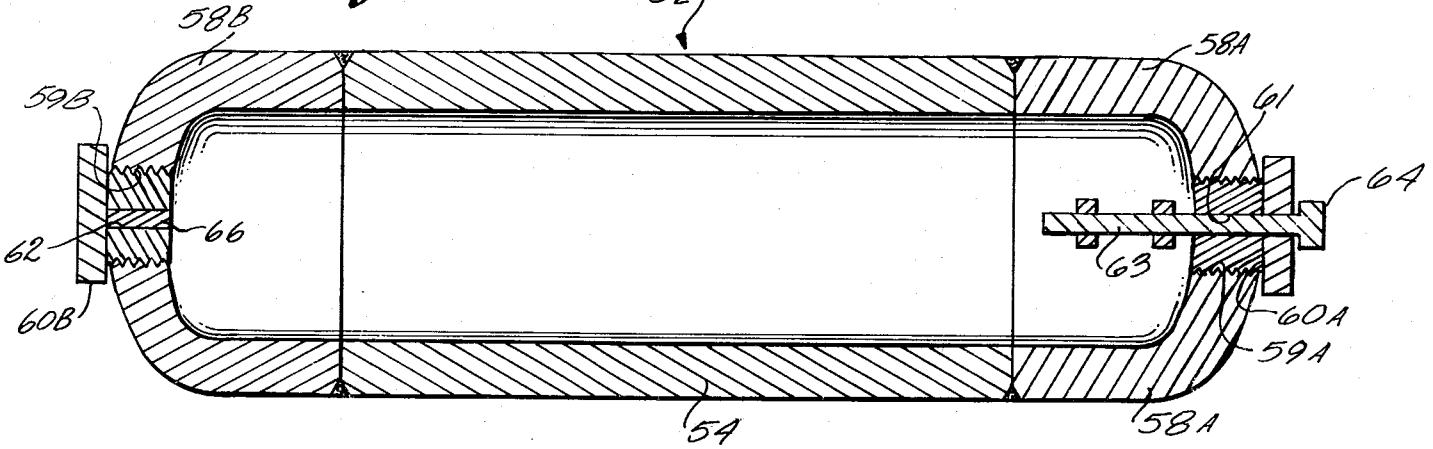
FIG. 5 shows in partial cross section a container for confining indicator means for use with the retorts of FIGS. 3 and 4.

Container means 52 useful for confining a fluid indicator source and releasing the indicator source at a selected temperature is shown in FIG. 5. The container 52, which is particularly useful for gaseous indicator providing means, is referred to herein as a "gas bomb". Such a gas bomb can also be used for confining a liquid indicator source. The container 52 comprises a cylindrical pipe 54 capped at both ends with welded on caps 58A and 58B.

Figure 6:
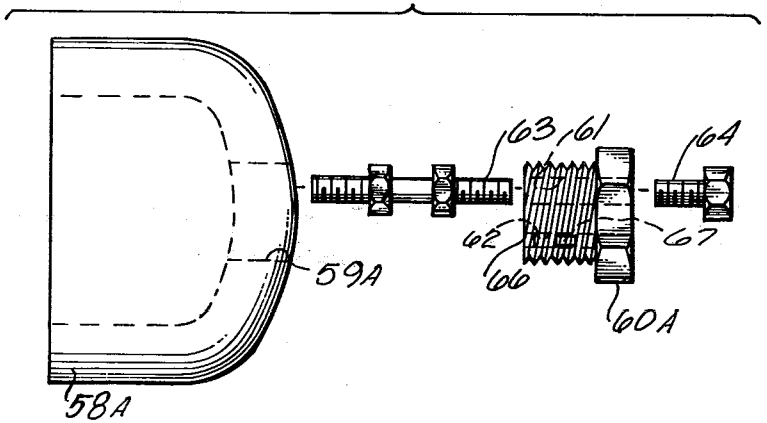
FIG. 6 is an exploded elevation view of a portion of another version of a container confining indicator means.

A filling mechanism is provided with a threaded plug 60A in a threaded hole 59A in one of the end caps 58A, and a discharging mechanism is provided with a threaded plug 60B in a threaded hole 59B in the other end cap 58B. A fill hole 61 is provided through one of the plugs 60A, and a release hole 62 is provided through the other plug 60B. Alternately, as shown in FIG. 6, both the fill hole 61 and the release hole 62 can be provided through the same plug. The fill hole 61, which is threaded, holds a check valve 63 having an elastomeric seal. The container is filled through the check valve which prevents premature release of indicator providing means. Since the elastomeric seal of the check valve 63 can degrade at the high temperatures of retorting, the exterior end of the fill hole 61 is closed with a plug 64 to prevent premature release of the contents of the container 52. The release hole 62 contains means for preventing release of the indicator means at a temperature less than the preselected temperature and for releasing the indicator means at the preselected temperature. In the version of the container of FIG. 5, a fusible cast plug 66 is provided in the release hole 62 for release of the indicator source. In the version of the container of FIG. 6 a pressure break diaphragm or rupture disc 67 responsive to high pressure in the container due to increase in the temperature of the indicator source is provided in the release hole 62.

The material for the fusible plug is one which fuses at the temperature at which it is desired to release the indicator source. Zinc, which melts at about 787° F., can be used. It is believed that in practice the zinc plug melts at a temperature characteristic of the temperature in the retorting zone.

Other materials which can be used for the plug include aluminum, aluminum alloys, lead, silver, brass, bronze, and magnesium alloys. For example, naval brass, which melts at 1625° F., can be used to release an indicator source at a temperature corresponding to a temperature in the combustion zone. By providing a first set of containers having zinc plugs and confining a first type of indicator source and a second set of containers having naval brass plugs and confining a second type of indicator source, where the indicators provided by the first and second types of indicator source are different from each other, the locus of both the retorting and combustion zones can be determined.

The size of container 52 provided for releasing an indicator source is dependent upon the desired concentration of the indicator in the effluent fluid from the retort. For example, when the indicator source is a halocarbon, preferably sufficient halocarbon is confined in the container 52 that a concentration of halocarbon of at least about 20 parts per million by volume appears in the off gas so that it can be detected by the monitoring means 38. A halocarbon can be confined as a liquid and released as a vapor to appear in the off gas.

The container and plug used for confining the indicator source must have sufficient strength to survive blasting to form the fragmented permeable mass when the container is placed in the retort prior to blasting. In addition, the container must be able to withstand the high temperatures and corrosive environment present in the retort for at least a sufficient time to prevent premature release of the indicator source. Corrosion of the container can be caused by sulfurous compounds present in gases passing through a retort. When a halocarbon is used as the indicator source, the container must be able to resist the internal pressures developed in the container due to heating of the halocarbon prior to its release at the selected temperature. Also, internal corrosion can be a problem when using halocarbons because of the chlorine and fluorine resulting from thermal decomposition of the halocarbon. Therefore, the choice of container material can be critical. Suitable materials for forming a container include Monel nickel-copper alloy, Inconel nickel-chromium alloy, and carbon steel of sufficient thickness that it does not corrode through before release of the indicator source.

Techniques utilizing features of this invention are demonstrated by the following examples.

EXAMPLE 1

Figure 3:
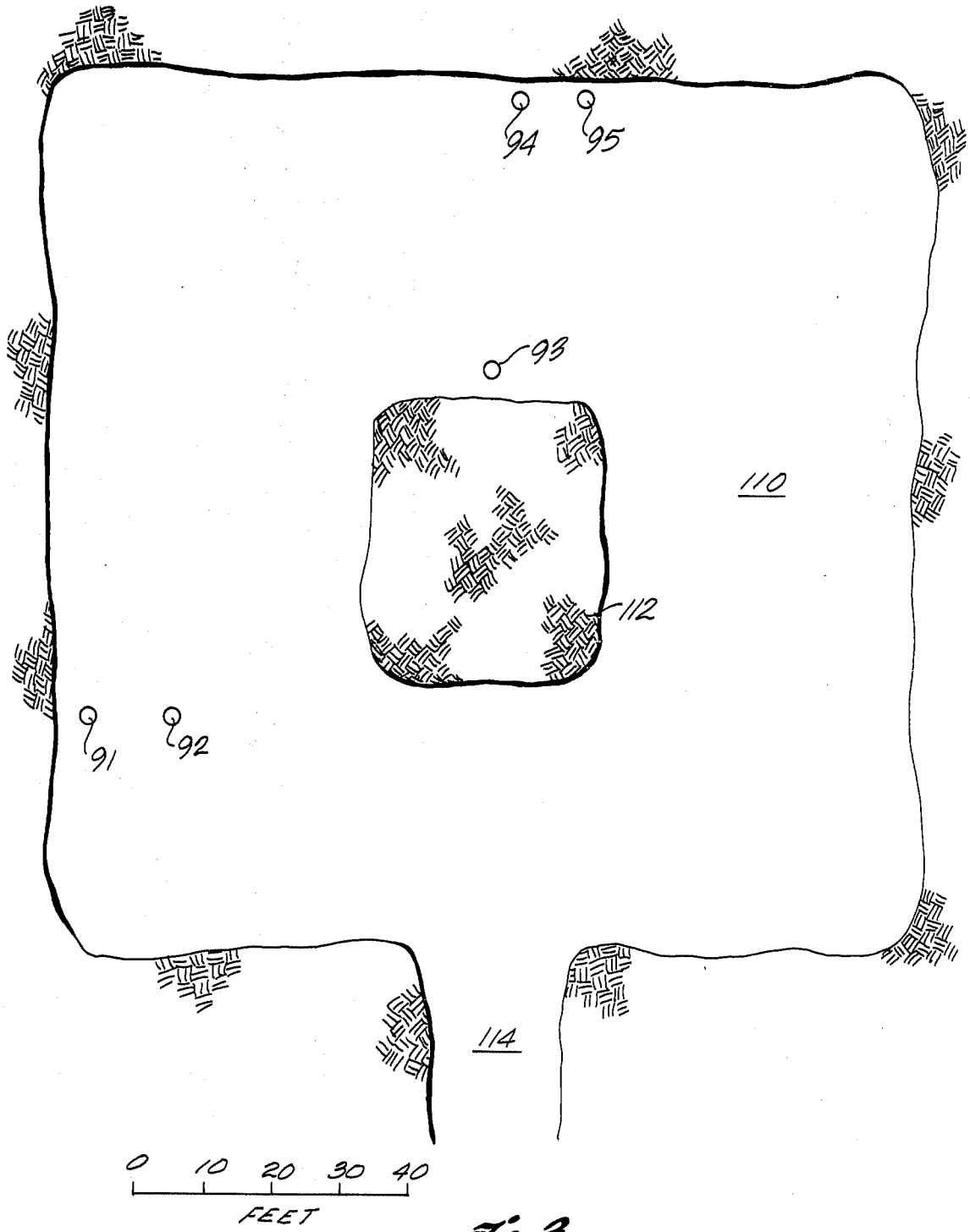
FIG. 3 is an overhead plan view of a work area for an in situ oil shale retort showing placement of indicator providing means in the retort for monitoring the locus of a processing zone in the retort.

FIG. 3 is an overhead plan view of a working level room 110 used in formation of an in situ oil shale retort in the south/southwest portion of the Piceance Creek structural basin in Colorado. Below the working level room is unfragmented formation which is to be expanded to form a fragmented mass of particles in the retort. The workroom is about 120 feet square, about the same dimensions as the fragmented mass in the retort. The fragmented mass to be formed extends downwardly into the formation for about 232 feet below the floor of the room 110. A central pillar 112 of unfragmented formation is left in place to support the roof of the working level room. A drift 114 is provided for access to the work room.

The fragmented mass in the retort was doped with gas bombs containing halocarbons. The containers, i.e., gas bombs, used for the halocarbons were prepared in accordance with the design shown in FIG. 5. Each container was formed from a 6 inch long piece of carbon steel pipe 54 having a nominal diameter of 3 inches. The carbon steel tubing used was ASTM A-53, Grade B, Schedule XX, SMLS tubing, with 0.6 inch wall thickness. Three inch end caps 58A and 58B were welded on the pipe. The filling mechanism was built into a 1 inch NPT hex plug 60A located in the end of one of the caps 58A and the discharge mechanism was built into a 1 inch NPT hex plug 60B located in the end of the other cap 58B. A threaded hole 59 was provided for each 1 inch hex plug. A threaded fill hole 61 in the plug 60A of the fill mechanism was provided for a one-quarter inch check valve 63. The outer end of the fill hole was sealed with a one-quarter inch NPT plug 64 after filling the cylinder with halocarbon.

A one-eighth inch release hole 62 in the plug 60B of the release mechanism was threaded full length with a 10-32 thread for extra bonding surface to avoid premature extrusion of the fusible plug from the hole as the plug softens at elevated temperatures. The release hole 62 was filled with a fusible plug 66 of pure zinc. The length of the hex plug 60B and the zinc plug 66 was about 1¼ inches.

The zinc plug 66 was placed in the release hole 62 by first cleaning the entire hex plug 60B with carbon tetrachloride, and then pickling the plug in inhibited hydrochloric acid at 120° F. The hex plug 60B was then placed on a fire brick and heated with an acetylene torch to the soldering temperature of zinc, i.e., from about 850 to 900° F. The release hole 62 was then flushed with a commercial silver solder flux. Zinc shots were added to the release hole 62, one at a time, with small amounts of flux between each shot. After soldering, the hex plug 60B was placed in an insulated box and allowed to cool slowly to prevent the fusible zinc plug 66 from receding from the wall of the hole.

The 0.6 inch wall thickness and short cylinder length of this bomb provide a strong, compact container capable of surviving a blast for forming the cavity and fragmented permeable mass of the retort of FIG. 3. The pipe specifications were:

estimated internal burst pressure=31,000 psi at 700° F.;

estimated crushing pressure=245,000 psi at 70° F.;

estimated shear resistance=218,000 pounds;

allowable working pressure (60% of yield) = 4,410 psi at 70° F.;

allowable working pressure (60% of yield) = 3,180 psi at 800° F.;

internal volume = 655 ml.

Because of the use of the pure zinc metal plug, it is expected that halocarbons used in the container are released at about 787° F.

Three bombs containing Freon 13 ($CClF_3$), three bombs containing Freon 113 ($CCl_2FCClF_2$), and two bombs containing Freon 116 ($C_2F_6$) were provided.

Each Freon 13 bomb was loaded with liquefied Freon under its own vapor pressure by connecting a Freon 13 cylinder to the bomb, placing the bomb in a bucket of ice water, and opening the cylinder valve to fill the bomb through the check valve 63. The port leading to the check valve was then plugged with the ¼ inch NPT plug 64. The initial and loaded weights of the bombs were recorded. The average empty weights of all bombs was about 18½ lbs. The net weights of the three Freon 13 bombs were 1 lb. 5 oz., 1 lb. 4 oz., and 1 lb. 0 oz.

The Freon 116 bombs were loaded in the same manner as the Freon 13 bombs. The net weights of the two Freon 116 bombs were 1 lb. 0 oz. and 0 lb. 11 oz.

Each Freon 113 bomb was filled with 300 ml. (446 grams) of liquid Freon 113.

Assuming complete mixing of halocarbon in the gas bomb with the gases flowing through the retort and a superficial gas flow rate through the retort of about 1 standard cubic foot per minute per square foot of fragmented permeable mass being retorted, it was calculated that the off gas would have a Freon concentration of from about 20 to about 100 parts per million by volume having a 5 second pulse with a 30 minute tail.

The means proposed for detecting Freon in the off gas was a Honeywell 1000 Hi-Speed gas chromatograph modified with a Valco valve for stripping hydrocarbons from gas samples and a Valco electron capture detector.

The placement of the gas bombs in the retort is shown in FIG. 3. Prior to blasting to form the retort, five bore holes 91, 92, 93, 94, 95 were formed by drilling downwardly from the floor of the working level room into the portion of the formation to be fragmented by blasting to form the retort.

A bomb containing Freon 113 was placed about 2½ feet down into bore hole 91, which had a 4½ inch diameter. Bore hole 92, which was 6½ inches in diameter, contained two Freon 116 bombs. One bomb was placed 87 feet down in the hole 92 and the other bomb was placed 10 feet down. Stemming with formation particles was used between the bombs; that is, formation particles were poured into the bore hole for filling.

Bore hole 93 was 4½ inches in diameter and contained one Freon 13 bomb. The bomb was placed 1 foot down in the bore hole 93 and was stemmed with formation particles.

Bore hole 94 was 6¼ inches in diameter and contained one Freon 13 bomb placed five feet down with formation particle stemming.

Bore hole 95 had a 6¼ inch diameter and three Freon 13 bombs were placed 174, 116 and 77 feet down the hole. Stemming with formation particles was used for the bottom bomb, sand stemming was used for the middle bomb, and no stemming to the top was used for the top bomb.

After placement of the bombs, formation was explosively expanded to form an in situ oil shale retort containing a fragmented permeable mass of formation particles containing oil shale. Subsequently oil shale in the fragmented mass was retorted.

The Honeywell chromatograph was not modified in time for the retorting operation and thus the locus of the advancing retorting and combustion zones could not be determined.

The bomb depths presented above were measured with a measuring rope to the lower end of the bomb. The fusible plug was always oriented upwardly, and was about one foot higher than the depth indicated. However, this could be offset by dropping of a bomb during blasting. It is estimated that during blasting to form the cavity and expand formation particles to form the fragmented permeable mass, bombs dropped on an average of about two feet. Therefore, it is estimated that the contents of the bombs were released at about one foot lower than the depth the bomb was placed in the bore hole.

EXAMPLE 2

Figure 4:
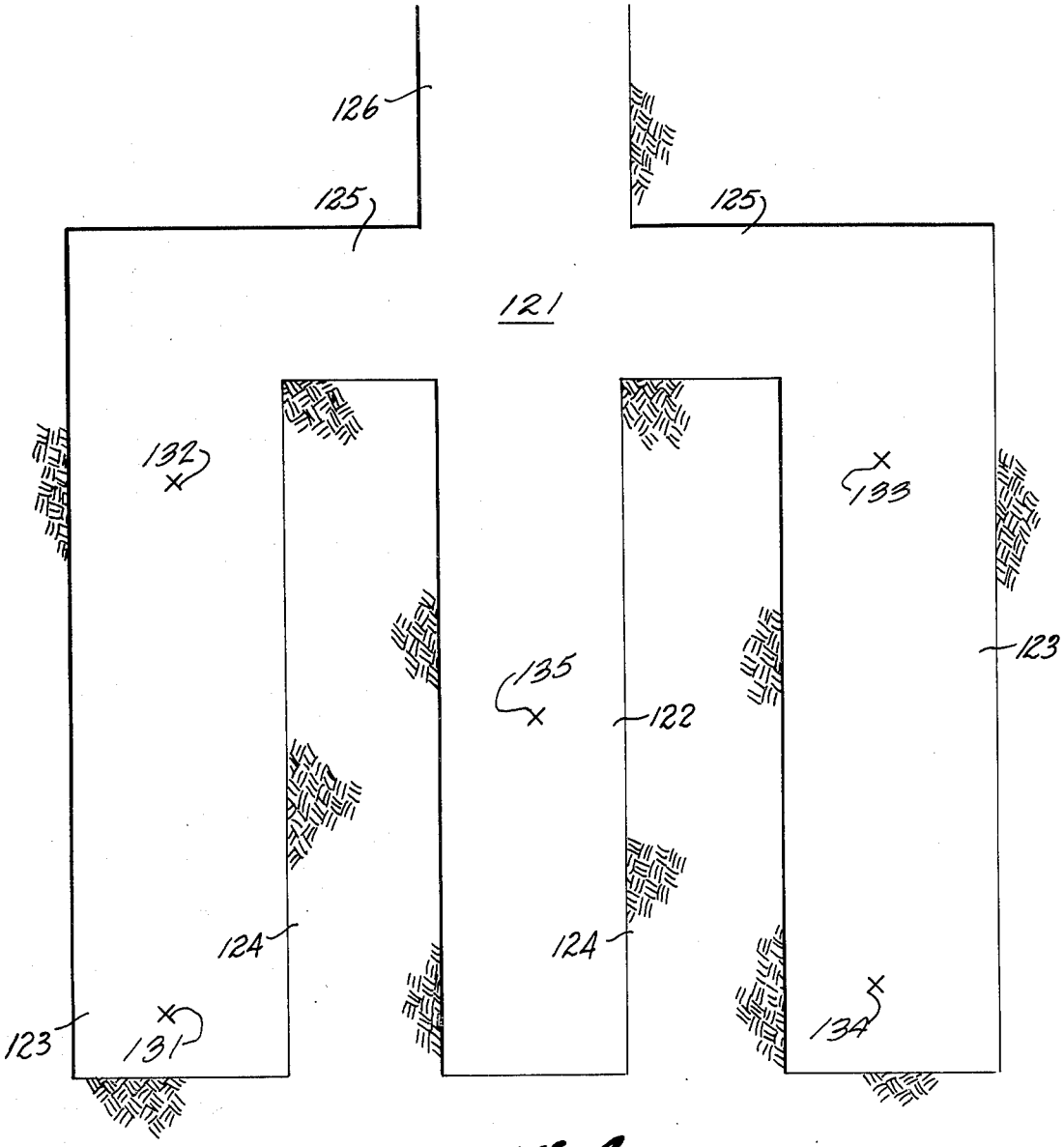
FIG. 4 is an overhead plan view of a work area for another retort showing placement of indicator providing means for monitoring the locus of a processing zone advancing through the retort.

FIG. 4 shows an overhead plan view of a subterranean base of operation or room 121 on a working level used for forming an in situ oil shale retort. The base of operation has a central drift 122 and a side drift 123 on each side thereof. The two side drifts are similar to each other. Elongated roof supporting pillars 124 of intact formation separate the side drifts 123 from the central drift 122. Short crosscuts 125 interconnect the side drifts 123 and central drift 122 to form a generally E-shaped excavation. A branch drift 126 provides access to the base of operation from underground mining development workings (not shown) at the elevation of the base of operation. The branch drift 126 leading to the base of operation is about 20 feet wide, and it and the drifts at the base of operation at the top of the retort site are about 14 to 16 feet high. The central drift 122 is about 25 feet wide and the side drifts 123 are about 30 feet wide. Each of the side drifts 123 is about 125 to 130 feet long. The central drift is about 120 feet long. The crosscuts 125 interconnecting these three drifts on the working level are about 30 feet wide. The pillars 124 of unfragmented formation left between the drifts in the E-shaped base of operation are about 20 to 25 feet wide and about 85 feet long.

Thirty gas bombs of the same type described in Example 1 were loaded with indicator providing means. The loadings of each bomb are presented in Table 1. It was attempted to load the bombs to about 70% of full to allow ullage for vaporization and expansion of the indicator in the bombs prior to release.

Five bore holes 131–135 were drilled downwardly from the floor of the base of operation 124. The location of each bore hole is marked by an "X" in FIG. 4. The depths of bore holes 131 to 135 were 220 feet, 206 feet, 212 feet, 213 feet and 209 feet, respectively. The bore hole provided for each bomb and the depth of the bomb in its respective bore hole are presented in Table 2. The depths presented in Table 2 are from the floor of the base of operation 124. Because of the presence of a 40 feet thick horizontal sill pillar below the base of operation, the bombs are actually placed 40 feet less into the fragmented mass than the depths recited in Table 2. For example, bomb 19 was 60 feet down measured from the floor of the base of operation, but because of the 40 feet thick sill pillar, bomb 19 was only 20 feet below the top of the fragmented mass.

A fragmented permeable mass (not shown) was formed by explosively expanding formation below the room. The fragmented mass was square with a side of about 118 feet and was about 165 to 200 feet deep with a sloping bottom boundary. A 40 feet thick horizontal sill pillar of unfragmented formation was left between the floor of the base of operation 124 and the top of the fragmented permeable mass.

TABLE 1

| BOMB NUMBER | GAS BOMB LOADING $SF_6$ (pounds) | FREON 13 (pounds) | FREON 12 (pounds) | FREON 11 (milliliters) | FREON 113 (milliliters) |
|---|---|---|---|---|---|
| #1 | 2.4375 | | | | |
| #2 | 1.7938 | | | | |
| #3 | 2.21817 | | | | |
| #4 | 1.6406 | | | | |
| #5 | 2.3281 | | | | |
| #6 | 1.4843 | | | | |
| #7 | | 1.6875 | | | |
| #8 | | 1.4219 | | | |
| #9 | | 1.3282 | | | |
| #10 | | 1.5469 | | | |
| #11 | | 1.0625 | | | |
| #12 | | 1.7657 | | | |
| #13 | | | 1.2813 | | |
| #14 | | | 1.5312 | | |
| #15 | | | 1.2344 | | |
| #16 | | | 1.4375 | | |
| #17 | | | 1.4219 | | |
| #18 | | | 1.5313 | | |
| #19–#24 | | | | 454 each | |
| #25–#30 | | | | | 454 each |

TABLE 2

| BOMB NUMBER | GAS BOMB LOCATION DEPTH (FEET) INTO BORE HOLE (measured from the floor of the base of operation) Hole 131 | Hole 132 | Hole 133 | Hole 134 | Hole 135 |
|---|---|---|---|---|---|
| 1 | | | | | 60 |
| 2 | | | | | 150 |
| 3 | | | | | 120 |
| 4 | | | | | 180 |
| 5 | | | | | 90 |
| 6 | | | | | 209 |
| 7 | 90 | | | | |
| 8 | 150 | | | | |
| 9 | 164 | | | | |
| 10 | 120 | | | | |
| 11 | 210 | | | | |
| 12 | 52 | | | | |
| 13 | | 180 | | | |
| 14 | | 90 | | | |
| 15 | | 205 | | | |
| 16 | | 120 | | | |
| 17 | | 150 | | | |
| 18 | | 60 | | | |
| 19 | | | 60 | | |
| 20 | | | 90 | | |
| 21 | | | 120 | | |
| 22 | | | 150 | | |
| 23 | | | 180 | | |
| 24 | | | 210 | | |
| 25 | | | | 60 | |
| 26 | | | | 90 | |
| 27 | | | | 120 | |
| 28 | | | | 150 | |
| 29 | | | | 180 | |
| 30 | | | | 210 | |

As with Example 1, it was expected that the bombs dropped about 2 feet during the blasting to form the retort, but since the bombs were placed so the zinc plug was oriented upwardly, the gas released by the bombs is about 1 foot lower than the depth value presented in Table 2. For example, bomb 19 releases Freon 11 at a depth below the floor of the base of operation of about 61 feet rather than 60 feet.

The same detection means proposed to be used for Example 1 are provided for the retort of Example 2. Data on presence of indicator in off gas from the retort are not yet available.

Monitoring the locus of the a processing zone advancing through the fragmented permeable mass 16 in the retort 10 has significant advantages. For example, steps can be taken to maintain the combustion zone flat and uniformly perpendicular to the direction of its advancement to minimize oxidation and excessive cracking of hydrocarbons produced in the retorting zone. In addition, the rate of introduction and composition of the retort inlet mixture can be controlled to maintain the temperature in the combustion zone sufficiently low to avoid formation of excessive amounts of carbon dioxide and to prevent fusion of the oil shale. Furthermore, knowledge of the locus of the combustion and retorting zones as they advance through the retort allows monitoring the performance of a retort. Knowledge of the locus of the combustion and retorting zones also allows optimization of the rate of advancement to produce hydrocarbon products with the lowest expense possible by varying the composition of and introduction rate of the retort inlet mixture.

Although this invention has been described in considerable detail with reference to certain versions thereof, other versions of this invention can be practiced.

Therefore, the spirit and scope of the appended claims should not be limited to the description of the preferred versions contained herein.

What is claimed is:

1. An apparatus for releasing means for providing an indicator at a selected temperature for determining the locus of a processing zone advancing through a fragmented permeable mass of particles in an in situ oil shale retort in a subterranean formation containing oil shale, the retort having a combustion processing zone advancing through the fragmented mass and a retorting processing zone advancing through the fragmented mass on the advancing side of the combustion processing zone, the apparatus comprising:

(a) container means;

(b) means for providing an indicator in the container means; and (c) means for releasing the indicator providing means from the container means at a selected temperature greater than ambient and characteristic of such a processing zone.

2. An apparatus as claimed in claim 1 in which the means for releasing the indicator providing means comprises a fusible plug.

3. An apparatus as claimed in claim 2 in which the processing zone is a retorting zone and the fusible plug comprises metallic zinc.

4. An apparatus as claimed in claim 1 in which the means for releasing the indicator providing means comprises a pressure break diaphragm.

5. An apparatus as claimed in claim 1 in which the indicator providing means is a gas or a liquid at ambient temperature, and wherein the apparatus includes a fill hole through a wall of the container means for filling the container means with the indicator providing means, and the apparatus also includes a check valve in the fill hole for preventing premature release of the indicator providing means.

6. An apparatus as claimed in claim 5 including a plug in the fill hole for preventing degradation of the check valve when the apparatus is in a retort, wherein the plug is positioned so that it is between the check valve and the fragmented mass in the retort.

7. An apparatus as claimed in claim 5 in which the means for release of the indicator providing means comprises a release hole in a plug, the plug being in a wall of the container, wherein the fill hole is in the same plug.

8. An apparatus for releasing means for providing an indicator at a preselected temperature for determining the locus of a processing zone advancing through a fragmented permeable mass of particles in an in situ oil shale retort in a subterranean formation containing oil shale, wherein the fragmented mass is prepared by explosive expansion of a portion of the formation and the apparatus is placed in such a portion of formation prior to such explosive expansion, the apparatus comprising:

(a) container means confining means for providing an indicator;

(b) a hole through a wall of the container means for release of the means for providing an indicator; and (c) plug means having a fusible portion in the hole for preventing release of the means for providing an indicator from the container means at a temperature less than the preselected temperature and for releasing the means for providing an indicator from the container means at the preselected temperature, wherein the container means and the plug means have sufficient strength that the fusible portion of the plug means can survive such explosive expansion.

9. An apparatus as claimed in claim 8 in which the fusible portion of the plug means consists essentially of metallic zinc.

10. An apparatus as claimed in claim 8 in which the processing zone is a retorting zone and the plug means releases means for providing an indicator at a temperature characteristic of the temperature of the retorting zone.

11. An apparatus as claimed in claim 8 in which the processing zone is a combustion zone and the plug means releases means for providing an indicator at a temperature characteristic of the temperature of the combustion zone.

12. An apparatus as claimed in claim 8 in which the container means is cylindrical.

13. An apparatus for releasing means for providing an indicator at a preselected temperature for determining the locus of a processing zone advancing through a fragmented permeable mass of particles in an in situ oil shale retort in a subterranean formation containing oil shale, wherein the fragmented mass is prepared by explosive expansion of a portion of the formation and the apparatus is placed in such a portion of formation prior to such explosive expansion, the apparatus comprising:

(a) container means confining means for providing an indicator;

(b) a threaded hole through a wall of the container means for release of the means for providing an indicator; and (c) plug means having a fusible portion engaging the threads of the hole for preventing release of the means for providing an indicator from the container means at a temperature less than the preselected temperature and for releasing the means for providing an indicator from the container means at the preselected temperature, wherein the container means and the plug means have sufficient strength that the fusible portion of the plug means can survive such explosive expansion.

14. An apparatus as claimed in claim 13 in which the fusible portion of the plug means consists essentially of metallic zinc.

15. An apparatus as claimed in claim 13 in which the processing zone is a retorting zone and the plug means releases means for providing an indicator at a temperature characteristic of the temperature of the retorting zone.

16. An apparatus as claimed in claim 13 in which the processing zone is a combustion zone and the plug means releases means for providing an indicator at a temperature characteristic of the temperature of the combustion zone.

17. An apparatus as claimed in claim 13 in which the container means is cylindrical.

18. An apparatus for releasing a fluorine containing halocarbon at a preselected temperature for determining the locus of a processing zone advancing through a fragmented permeable mass of particles in an in situ oil shale retort in a subterranean formation containing oil shale, wherein the fragmented mass is prepared by explosive expansion of a portion of the formation and the apparatus is placed in such a portion of formation prior to such explosive expansion, the apparatus comprising:

(a) container means confining a fluorine containing halocarbon;

(b) a hole through a wall of the container means for release of the fluorine containing halocarbon; and (c) plug means having a fusible portion in the hole for preventing release of the fluorine containing halocarbon from the container means at a temperature less than the preselected temperature and for releasing the fluorine containing halocarbon from the container means at the preselected temperature, wherein the container means and the plug means have sufficient strength that the fusible portion of the plug means can survive such explosive expansion.

19. An apparatus as claimed in claim 18 in which the fusible portion of the plug means consists essentially of metallic zinc.

20. An apparatus as claimed in claim 18 in which the processing zone is a retorting zone and the plug means releases means for providing an indicator at a temperature characteristic of the temperature of the retorting zone.

21. An apparatus as claimed in claim 18 in which the processng zone is a combustion zone and the plug means releases means for providing an indicator at a temperature characteristic of the temperature of the combustion zone.

22. An apparatus as claimed in claim 18 in which the container means is cylindrical.

23. An apparatus for releasing at about 800° F. a halocarbon for determining the locus of a retorting zone advancing through a fragmented permeable mass of particles in an in situ oil shale retort in a subterranean formation containing oil shale, the apparatus comprising:

(a) a container;

(b) a halocarbon in the container;

(c) a threaded hole through a wall of the container for release of the halocarbon; and (d) plug means having a fusible portion consisting essentially of metallic zinc in the hole in contact with the threaded portion for preventing release of the halocarbon at a temperature less than the melting point of the metallic zinc and for releasing the halocarbon at about the melting point of the metallic zinc.

24. An apparatus as claimed in claim 23 in which the fragmented permeable mass of particles is formed by explosive expansion of a portion of the formation, and the apparatus is placed in such a portion prior to such explosive expansion, and wherein the container and plug means have sufficient strength that the fusible portion of the plug means can survive such explosive expansion.

25. An apparatus for releasing means for providing an indicator at a preselected temperature for determining the locus of a processing zone advancing through a subterranean formation, the processing zone being characterized by a temperature higher than ambient temperature, the apparatus comprising:

(a) container means confining means for providing an indicator;

(b) a hole through a wall of the container means for release of the means for providing an indicator; and (c) plug means having a fusible portion in the hole for preventing release of the means for providing an indicator from the container means at a temperature less than a preselected temperature greater than ambient temperature and characteristic of such a processing zone, and for releasing the means for providing an indicator from the container means at the preselected temperature.

26. An apparatus as claimed in claim 25 in which the fusible portion of the plug means consists essentially of metallic zinc.

27. An apparatus as claimed in claim 25 in which the container means is cylindrical.

28. An apparatus for releasing means for providing an indicator at a preselected temperature for determining the locus of a processing zone advancing through a subterranean formation, the processing zone being characterized by a temperature higher than ambient temperature, the apparatus comprising:

(a) container means confining means for providing an indicator;

(b) a threaded hole through a wall of the container means for release of the means for providing an indicator; and (c) plug means having a fusible portion engaging the threads of the hole for preventing release of the means for providing an indicator from the container means at a temperature less than the preselected temperature and for releasing the means for providing an indicator from the container means at the preselected temperature.

29. An apparatus as claimed in claim 28 in which the fusible portion of the plug means consists essentially of metallic zinc.

30. An apparatus as claimed in claim 28 in which the container means is cylindrical.

* * * * *

UNITED STATES PATENT AND TRADEMARK OFFICE

CERTIFICATE OF CORRECTION

PATENT NO. : 4,149,592

DATED : April 17, 1979

INVENTOR(S) : Robert S. Burton, Carl C. Chambers

It is certified that error appears in the above-identified patent and that said Letters Patent are hereby corrected as shown below:

Column 2, line 21, after "of" and before "the" insert -- parts of --.

Column 16, line 55, "processng" should be -- processing --.

Signed and Sealed this

*Fourth* Day of *September 1979*

[SEAL]

*Attest:*

*Attesting Officer*

LUTRELLE F. PARKER

*Acting Commissioner of Patents and Trademarks*